United States Patent [19]

Büchner

[11] 4,296,714

[45] Oct. 27, 1981

[54] DUAL PISTON TWO STROKE ENGINE

[76] Inventor: Bernhard Büchner, Ott-Heinrich-Strasse 25, D-8070 Ingolstadt-Unsernherrn, Fed. Rep. of Germany

[21] Appl. No.: 141,569

[22] Filed: Apr. 18, 1980

[30] Foreign Application Priority Data

Jun. 13, 1979 [DE] Fed. Rep. of Germany ..... 2923941

[51] Int. Cl.[3] ..... F02B 25/12

[52] U.S. Cl. ..... 123/53 B; 123/73 AA; 123/73 AE

[58] Field of Search ..... 123/53 B, 73 AA, 73 A, 123/73 AE, 59 B

[56] References Cited

U.S. PATENT DOCUMENTS

| | | | |
|---|---|---|---|
| 1,149,142 | 8/1915 | Horner | 123/53 B |
| 2,536,960 | 1/1951 | Sherwood | 123/53 B |
| 4,079,705 | 3/1978 | Büchner | 123/53 B |

FOREIGN PATENT DOCUMENTS

| | | | |
|---|---|---|---|
| 734000 | 4/1943 | Fed. Rep. of Germany | 123/53 B |
| 2347809 | 4/1975 | Fed. Rep. of Germany | 123/53 B |
| 246813 | 4/1926 | Italy | 123/53 B |

*Primary Examiner*—Wendell E. Burns

*Attorney, Agent, or Firm*—Wegner, Stellman, McCord, Wood & Dalton

[57] ABSTRACT

A two stroke internal combustion engine with at least one dual piston, the cylinders of which are connected to each other by a combustion chamber on the cylinder head side. The engine can be charged on the crank chamber side with an air or air/fuel mixture by a turbo or supercharger. Both the leading and trailing pistons of the dual piston construction control the process of transfer of the air or air/fuel mixture through a transfer port from the crank chamber side of the cylinders to the combustion chamber side of the cylinder for the trailing piston as well as the exhaust process such that the exhaust process begins before the initiation of the transfer process. The engine can operate on either the Otto or Diesel cycles and use multiple fuels.

12 Claims, 5 Drawing Figures

DUAL PISTON TWO STROKE ENGINE

DESCRIPTION

1. Technical Field

This invention relates to a two stroke internal combustion engine of the dual piston type.

2. Background Art

A two stroke internal combustion engine of the dual piston type is disclosed in my prior U.S. Pat. No. 4,079,705. In the engine therein disclosed, the transfer of combustion air or an air/fuel mixture from the crank chamber to the combustion chamber is controlled exclusively by the leading piston such that the angles of crank rotation corresponding to the period of the exhaust process and to the transfer process have the same bisector. The crank angles are shifted with respect to lower dead center of the cycle in a direction opposite to the direction of rotation. The leading piston closes a transfer port before the exhaust process is completed and the compression stroke of the dual piston therefor begins only after the completion of the transfer process so that a pressure drop from the combustion chamber to the crank chamber cannot occur. Such a pressure drop is to be avoided in that it would cause reverse flow of the air or air/fuel charge from the combustion chamber to the crank chamber.

The transfer process determines the degree of charging of the combustion chamber and thus, the power and efficiency of the engine. In the case of the engine described in my above identified patent, it has been found that when the crank chamber is super or turbo charged, the combustion chamber cannot be charged to the desired degree because the length of the transfer process is too short and there may remain such an undesirable pressure drop.

DISCLOSURE OF THE INVENTION

The present invention provides a two stroke internal combustion engine with dual pistons that positively insures that no air or air/fuel mixture charged to the combustion chamber will backflow into the crank chamber as well as provides optimum charging of the combustion chamber.

According to the invention, a transfer port leads from the crank chamber sides of the cylinders for both the leading and trailing piston to the combustion chamber side of the trailing piston. Thus, the transfer process is controlled by both the leading and the trailing piston with the transfer port opening relatively early in the cycle under control of the leading piston and closing relatively late in the cycle by the trailing piston. The leading piston controls the exhaust process and the initiation of the transfer process. Subsequently, the trailing piston opens the transfer port and as a result increases the effective cross sectional area of the flow path decreasing resistence to flow. The end of the transfer process is controlled exclusively by the trailing piston. As both pistons control the transfer ports, the volume of the transfer port may be maintained relatively small so that the effect of its volume on attainable compression in the crank chamber is insignificant.

By the control of the transfer process through both pistons, the transfer process can occur over a crank angle of about 180° extending approximately 90° to either side of lower dead center. The angle is limited only by the pressure drop between the crank chamber and the combustion chamber and is dependent upon the degree of turbo or supercharging of the crank chamber and/or the boost pressure generated in the crank chamber.

Preferably, the invention produces crank chamber compression or boost at a rato of at least 1.5:1. This can be attained by a high power crank chamber pump which controls the admission of air or an air/fuel mixture into the crank chamber, as, for example, through the use of the peripheral surfaces of a combined crank and rotary valve or a pair of combined cranks and rotary valves which journal the connecting rod of the dual piston. The peripheral surface of such a mechanism is utilized as a valve in connection with an intake and moves in close adjacency or with only slight contact pressure against the intake.

Alternately, other charging devices such as gas dynamic oscilatory devices may be utilized. For example, resonance tubes, resonance volumes or similar devices which are configured to operate over the design engine speed of the engine may be employed.

The structure is such that the trailing piston normally closes the transfer port substantially simultaneously with the completion of the exhaust process which is controlled by the leading piston. However, where crank chamber components provide a high crank chamber compression ratio, additional charging of the combustion chamber is possible according to the invention by causing the trailing piston to close the transfer port only after completion of the exhaust process. In such a case, the control surfaces employed for control of the trnsfer process must be oriented such that the boost pressure in the crank chamber be sufficiently higher than the initial compression pressure within the combustion chamber, generally, up to 0.5 atmospheres higher.

Preferably, the trailing piston and leading piston respectively open the transfer port at different times to provide preliminary charging or preliminary exhaust as desired dependent upon the intended operational speed of the apparatus.

It is desirable that the charging process on the crank chamber side through the intake begins before the trailing piston closes the transfer port. Thus, the introduction to the crank chamber of air or an air/fuel mixture at high initial pressure as by super or turbo charging provides an immediate increase of pressure in the crank chamber to increase the velocity of gas flow to the combustion chamber through the transfer port and prevent reverse flow from the combustion chamber to the crank chamber.

In a preferred embodiment, the transfer port is provided in both sides of the cylinder block wall which separates the cylinders of the dual piston. These transfer ports are controlled by windows in the skirt of the two pistons below the piston-ring zones. Thus, the incoming gases cool the separating wall. Alternately, cooling water channels in the separating wall my be provided.

Essential advantages are provided by a structure in which at least a part of the combustion-chamber wall, facing the piston heads, is formed by a counterpiston movably disposed in the cylinder head to be advanced toward the pistons with the aid of a power device. In this embodiment the compression ratio of the internal combustion engine can be changed in a structurally simple manner during engine operation, depending on the position of the throttle of the internal-combustion engine. In operation with a partial load, the compression can be increased so that a lower fuel consumption is attained in the entire load range, without a typical knocking or pinging sound occurring as it is known in the case of diesel engines. A change of the compression ratio within the range of approximately 1:2 was found to be sufficient and practical. For example, a compression ratio of 8:1 at a full load can be increased to 16:1 under operation with partial load. A hydraulic cylinder receives the counter-piston and is controlled by a hydraulic control, depending on the position of the throttle. However, the counter-piston can also be displaced through a notch or ring set or similar arrangement. A sparkplug may be disposed in a central position in the counter-piston so that it is moved together with the counter-piston. However, the sparkplug can also be placed on the periphery of the combustion chamber defined by the cylinder head.

In order to obtain uniform or even combustion, the spark plug extends into the combustion chamber and has a counter-electrode on one of the surfaces of the cylinder-block wall which faces the combustion chamber and which is between the two pistons. The sparkplug can be arranged in the middle of the combustion space on the cylinder head so that an ignition spark is produced which travels transversely through the combustion chamber to the opposing surface of the cylinder-block wall which serves as the grounded electrode. The high voltage necessary for the production of a long ignition spark can be easily attained with the aid of a high-voltage condenser. Alternately, the spark plug and the counter-electrode can also be arranged next to one another on the surface of the engine block wall which faces the combustion chamber. This arrangement has the advantage of requiring relatively little space in the combustion chamber, making more space available for the location of other components, as for example, a fuel injection nozzle, etc.

Another aspect of the invention concerns the lubrication of the connecting rod and the main bearings of the dual piston. Preferably, the connecting rod bearings and the main bearings are sealed from the crank chamber. Lubricant pipes from a central oil supply open into the enclosed inner spaces of the bearings. Thus, any oil escaping from the bearings into the crank chamber can be taken into consideration as part of the total amount of oil necessary for the operation of the internal-combustion engine, that is, can be deducted from the amount of fresh oil which is introduced into the air or air/fuel mixture for the lubrication of the pistons. The oil from the central oil supply can be directed to the bearings from an oil tank with the aid of an oil pump, or by gravity (droplet lubrication), possibly assisted by a slightly elevated pressure in the oil tank.

Below is explained certain embodiments of the invention with the aid of drawings. The following are shown:

DESCRIPTION OF THE PREFERRED EMBODIMENT

Figure 1:
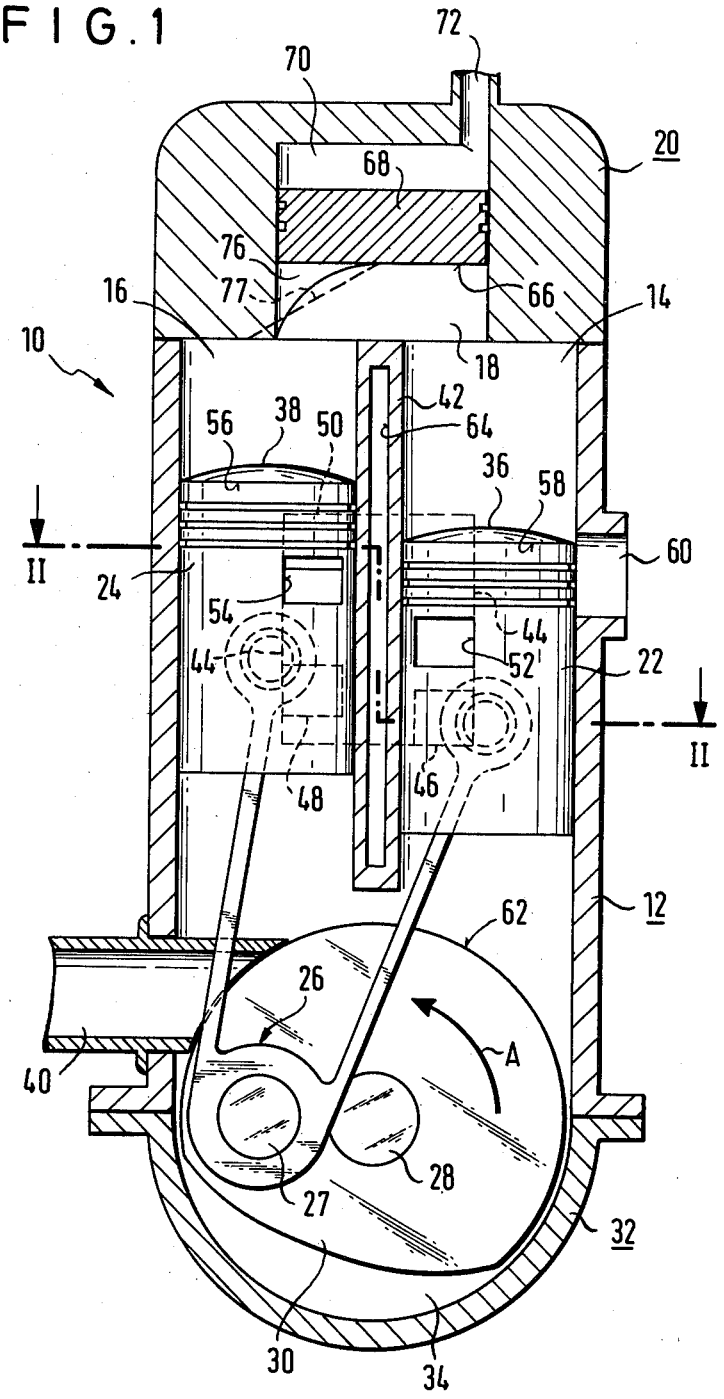
FIG. 1 is a schematic section, containing the the cylinder axis, through a two-stroke internal combustion engine.
Figure 2:
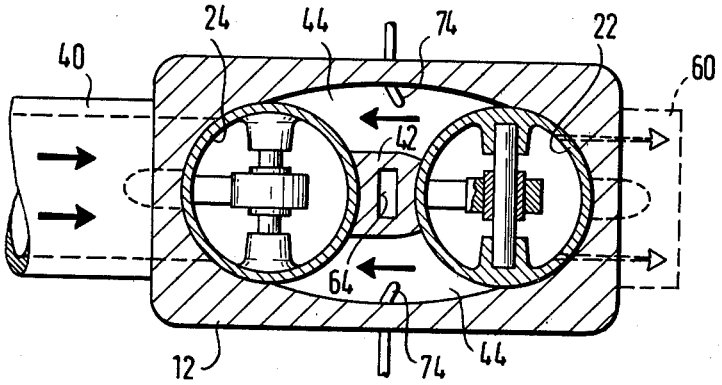
FIG. 2 is a section along line II—II in FIG. 1.

FIGS. 1 and 2 show a two-stroke internal combustion engine 10, the cylinder block 12 of which has two cylinders, 14 and 16. The cylinders 14 and 16 are closed by a cylinder head 20, which contains a combustion chamber 18, which in turn extends between the cylinders 14 and 16. The cylinders 14 and 16 receive reciprocable pistons 22 and 24, respectively, which are joined eccentrically through a common connecting rod 26 with the aid of a crank pin 27 to an eccentric disk 30, which is mounted on a shaft 28 defining the engine crank shaft. The eccentric disk 30 rotates in a crank chamber 34, which is closed by a pan 32.

The cylinders 14 and 16 are divided by the heads 36 and 38, respectively, of the pistons 22, 24 into a cylinder section on the combustion chamber 18 side and into a cylinder section on the crank chamber 34 side. Together with crank chamber 34, and the reciprocating pistons 22 and 24, the cylinder sections on the crank chamber side form a crank chamber pump, which serves to aspirate combustion or an air/fuel mixture through an intake 40 in fluid communication with the crank chamber 34.

The cylinders 14 and 16 are separated by a wall 42 of the block 12. Transfer ports 44 are formed on both ends of the wall 42 for the purpose of transferring the combustion air or air/fuel mixture from the crank chamber 34 to the cylinders 14 and 16 on their combustion chamber sides and into the combustion chamber 18. The transfer ports 44 each have inlet orifices 46 and 48 in the cylinders 14 and 16, respectively, on the crank chamber sides thereof along with an outlet orifice 50 on the combustion chamber side of the cylinder 16 only. The inlet orifices 46 and 48 are opened and closed by windows 52 and 54 respectively formed in the skirts of the corresponding pistons 22 and 24. The outlet orifice 50 is opened or closed by the upper edge 56 of the trailing piston 24. The upper edge 58 of the leading piston 22 controls the opening and closing of an exhaust port 60 formed in the combustion chamber side of the cylinder 14. The intake of combustion air or an air/fuel mixture is controlled by the eccentric disk 30, and specifically the periphery 62 thereof, which is configured to open and close the intake 40, either by close proximity thereto or by light contact therewith.

The internal combustion engine operates as follows: When the eccentric disk 30 rotates in the direction of an arrow A, the piston 22 always leads the piston 24 through the cycle. As shown in FIG. 1, the intake process is already completed and the eccentric disk 30 has closed the intake 40. The air or air/fuel mixture previously introduced into the crank chamber 34 is compressed by the downwardly moving pistons 22 and 24. At this time, the inlet orifices 46 and 48 of the transfer port 44 are closed. At a point before the windows 52 of the leading piston 22 reach the inlet orifices 46 of the transfer port 44, the upper edge 58 thereof opens the exhaust orifice 60 allowing the products of combustion to exit the combustion chamber 18 and the cylinders 14 and 16. Thereafter, the upper edge 56 of the trailing piston 24 opens the outlet orifice 50 of the transfer port 44. Shortly thereafter, or even simultaneously therewith, the window 52 of the leading piston 22 opens the inlet orifice 46 of the transfer port 44. Therefore, the compressed gas in the crank chamber 34 flows through the transfer port 44 into the combustion chamber side of the cylinders 14 and 16 and into the combustion chamber 18. This gas flow cools the separating wall 42 which, if desired, can alternately be water cooled as at 64.

The windows 54 of the trailing piston 24 align with the inlet orifices 48 of the transfer ports 44 after the leading piston 22 has moved to a position to allow the inlet orifices 46 to be opened. The timing is such that the piston 22 closes the inlet orifices 46 at a time when the exhaust orifice 60 remains open and the inlet orifices 48 controlled by the piston 24 remain open beyond this point of time. The inlet orifices 48 are closed generally at or about the time when the piston 22 closes the exhaust orifice 60. However, if the boost pressure in the crank chamber 34 is sufficiently high, the inlet orifices 48 may remain open beyond the end of the exhaust process so that the combustion chamber sides of the cylinders 14 and 16 and the combustion chamber 18 can continue to be charged with air or an air/fuel mixture through the transfer ports 44 even as the compression stroke begins. To this end, the peripheral surface of the eccentric disk 30 may be configured to open the intake 40 before the inlet orifices 48 close. Thus, the pressure of a super or turbocharged air or air/fuel mixture applied to the inlet 40 at this time will not only charge the crank chamber 34 but cause flow of the charging gas through the transfer ports 44 to the combustion chamber 18.

The transfer-flow process can be extended over a crank angle of about 90° on either side of lower dead center. It is limited essentially only by the magnitude of the pressure drop occurring during flow from the crank chamber 34 to the transfer ports 44 into the combustion chamber side of the cylinder 16. Preferably, the pressure difference between the boost pressure and the crank chamber 34 and the pressure of the gases in the combustion chamber 16 at the initiation of compression should be on the order of between about 0.5 and 1.5 atmospheres.

A wall 66 of the combustion chamber 18 facing the piston heads 36 and 38 may be formed by a counter-piston 68 close fitted, but movable, within a hydraulic cylinder 70. The cylinder 70 is connected to a suitably controlled source of hydraulic fluid under pressure by a conduit 72 and the position of the counter-piston 68 within the cylinder 70 is controlled as a function of the throttle position of the engine. By shifting the counter-piston 68 within the cylinder 70, the compression ratio in the cylinders 14, 16, can be varied dependent upon the throttle position. The control may be used to increase the compression ratio in the partial load region, for example, by doubling the compression ratio. Through suitable adjustment of the counter-piston 68, fuel consumption may be optimized over the entire load region thereby providing for a significant decrease in fuel consumption over that which would be present in an otherwise identical fixed compression ratio engine.

As shown in FIGS. 1 and 2, fuel injection nozzles 74 open into the transfer channels 44 to inject fuel in a direction opposite the direction of gas flow within the transfer ports 44. This method of injection is suitable for engines operating on either the diesel or Otto cycles and permits qualitative control as well as quantative control. In the former, only the fuel injected is controlled while the combustion chamber is completely charged with air, while in the latter, fuel injection is continuous during the entire filling.

Preferably, the combustion chamber 18 has an essentially cylindrical shape. In cross section, it is provided with two diametrically opposed regions which extend from the end of the combustion chamber remote from the cylinders to the cylinders 14 and 16 in the form of bulges 76 which have both spherical and rectangular characteristics. By forming the combustion chamber 18 in this configuration, gases being compressed during upward movement of the pistons 22 and 24 flow tangentially into the combustion chamber 18 to be swirled around quite effectively with a considerable twisting effect. This occurs at a time in the cycle where no power loss occurs as a result of swirling and twisting.

If desired, the bulges 76 need not be bounded by a surface having spherical and rectangular characteristics. Rather, they may be formed by straight ramps which extend beyond the cylindrical axis of the cylinders 14 and 16 as shown in dotted lines at 77 in FIG. 1 and in dotted lines 79 in FIG. 4.

Figure 3:
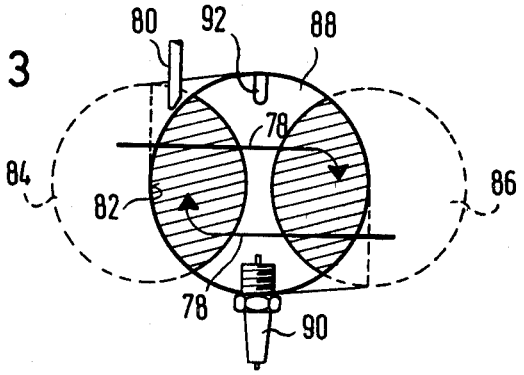
FIG. 3 is a section normal to the cylinder axis through a modified embodiment of a combustion chamber of a two stroke internal combustion engine.

FIG. 3 shows a modified embodiment in which the high twisting motion produced in the combustion chamber, shown by arrow 78, is utilized with fuel injection. A nozzle 80 injects fuel against the twisting gas flow either directly toward the wall 82 of the combustion chamber lying between cylinders 84, 86 (corresponding to the cylinders 14 and 16 in FIG. 1) or into the area immediately adjacent the wall 82. A separating wall 88 is located between the two cylinders 84, 86 and faces the combustion chamber. A spark plug 90 is disposed on the upper side of the wall 88, is suitably insulated, and extends into the combustion chamber. The counter electrode 92 of the spark plug 90 is disposed on the wall 88. The spark plug elements 90 and 92 could alternatively be integrated into the cylinder head gasket so that the combustion chamber is unobstructed to provide room for placement of other components such as the fuel injection nozzle 80.

Figure 4:
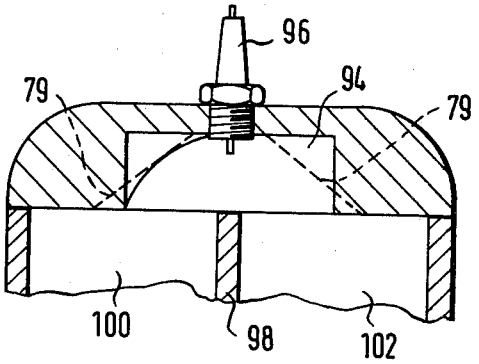
FIG. 4 is a section parallel to the axis through a further modified embodiment of a combustion chamber of a two-stroke internal combustion engine.

FIG. 4 shows a modified embodiment wherein the combustion chamber 94 is provided with a spark plug 96 which is centrally disposed. The counter-electrode of the spark plug 96 is defined by the separating wall 98 between two cylinders 100 and 102 (corresponding to the cylinders 14 and 16). The use of a high voltage condenser ignition system will produce sufficiently high voltage to travel the relatively large gap between the electrodes.

Figure 5:
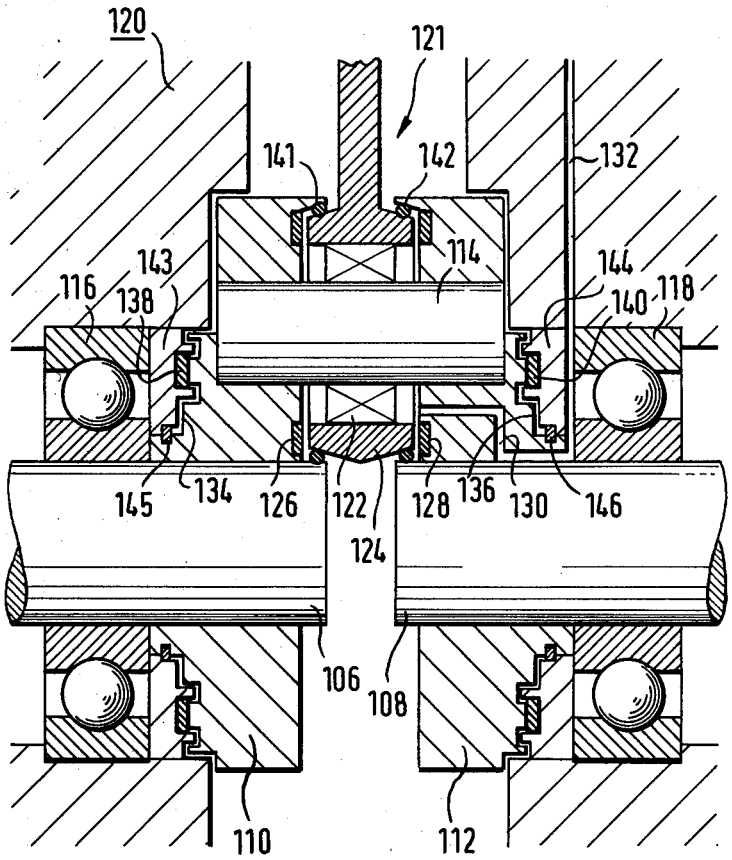
FIG. 5 is a section which contains the axis of rotation through a crank shaft with connecting rods, in a two-stroke internal combustion engine.

The invention is preferably supplied with oil from a central oil supply such as a tank (not shown), either with the assitance of an oil pump (not shown) or with a gravitational assit to assure lubrication of the pistons. Oil is introduced into the intake stream entering the crank chamber 34 through the intake 40 at a ratio to the fuel/air mixture or air between 1:80 and 1:200 dependent upon engine loading. FIG. 5 illustrates the means by which movable components other than the pistons are lubricated. The engine crank includes two eccentric disks, 110 and 112, which are axially separated and secured to rotary shafts 106 and 108 forming the engine crank shaft. A crank pin 114 extends between the disks 110 and 112 parallel to, but offset from, the rotational axis of shafts 106 and 108.

The shafts 106 and 108 are journalled in roller bearings 116 and 118 disposed in the block 120 of the engine. A connecting rod 121 corresponding to the rod 26 in FIG. 1 is journalled on the crank pin 114 by a roller bearing 122 between the eccentric disks 110 and 112.

The connecting rod 121 has an outer bearing ring 124 radially outwardly of the roller bearing 122 and the axially opposite side faces thereof may seal against the disks 110 and 112 by contact with sealing rings 126 and 128 as well as rings 141 and 142. If desired, the rings 126 and 128 may be omitted in favor of the rings 141 and 142 or vice versa. Preferably, the interfaces of the components bearing the rings 141 and 142 are provided with annular grooves for receiving the rings. A lubricant channel 130 opens into the sealed chamber thus defined and is connected to the central oil supply (not shown) by means of a conduit 132. The sides of the eccentric disks 110 and 112 which are axially remote from each other each carry the moving half of a respective labyrinth seal 134, 136. The stationary halves of the labyrinth seals are designated 143 and 144 ad are carried by the block 120. Parts of the labyrinth seals 134 and 136 are sealed by sealing rings 138, 140 and piston rings 145 and 146 in the positions illustrated in FIG. 5. The piston ring 145, 146 serving as seals in the labyrinth seals rotate with the shafts 106 and 108 while the remaining components of each labyrinth seal are fixed to the block 120. Additional seals (not shown) are located on the sides of the roller bearings 116 and 118 remote from the labyrinth seals 134 and 136 to completely enclose the roller bearings 116 and 118. The conduit 132 is in fluid communication with the interior of the chamber housing the roller bearings 116 and 118 as described above.

The construction shown in FIG. 5 provides an advantage in that lubricating oil for the components illustrated can be suitably metered as it is supplied to the conduit 132. The amount of oil provided to the conduit 132 is taken as a measure of the oil which inevitably leaks to the crank chamber past the various seals described and of course, such escaped oil may then serve the function of piston lubrication. Consequently, the amount of oil to be introduced into the air/fuel mixture or air being directed into the intake 40 (FIG. 1) can be reduced by an amount corresponding to that being introduced into the conduit 132. Thus, the total oil consumption of the engine is reduced and will remain reduced for the life of the engine as the system self-compensates for engine wear. This is in contrast to oil sump lubricated engines wherein increasing engine wear causes increased oil consumption.

I claim:

1. In a two stroke reciprocating engine, the combination of:

first and second cylinders;

first and second pistons reciprocably disposed in corresponding ones of said cylinders;

a crank chamber connecting said cylinders on corresponding ends thereof;

a combustion chamber connecting said cylinders on the ends thereof opposite said corresponding ends;

a crank rotatable in said crank chamber;

means connecting both of said pistons to said crank such that for one direction of rotation of said crank said first piston precedes said second piston during a reciprocating cycle thereof;

a transfer port for transferring at least combustion air from the crank chamber sides of said pistons to the combustion chamber sides of said pistons, said transfer port having first and second inlets in said first and second cylinders respectively and an outlet only in said second cylinder; and control surfaces on said pistons for opening and closing said inlets and outlet such that said second inlet remains open later in said reciprocating cycle than said first inlet to thereby lengthen the period in said reciprocating cycle during which said transfer of at least combustion air may occur.

2. The engine of claim 1 further including an exhaust port in said first cylinder and a further control surface on said first piston for opening said exhaust port before either of said inlets open and for closing said exhaust port at about the time said second inlet is closed.

3. The engine of claim 2 wherein said exhaust port and said second inlet are closed by said control surface substantially simultaneously.

4. The engine of claim 2 wherein said control surfaces close said second inlet slightly after said exhaust port is closed to allow further charging of said combustion chamber due to boost pressure in said crank chamber.

5. The engine of claim 1 wherein means are disposed in said crank chamber for producing a crank chamber compression ratio of at least 1.5:1.

6. The engine of claim 1 wherein said control surfaces on said pistons are arranged to open said first and second inlets at different times in an operational cycle of the engine.

7. The engine of claim 1 further including means in said crank chamber for admitting an air or air/fuel mixture thereto at selective points in the operating cycle of the engine including a point occurring before said transfer port is closed.

8. The engine of claim 1 further including means for selectively varying the compression ratio in said combustion chamber.

9. The engine of claim 8 wherein said selective varying means comprises a movable counter-piston defining a wall of said combustion chamber.

10. The engine of claim 1 wherein said first and second cylinders are defined by an engine block and wherein a spark ignition device extends into said combustion chamber and includes a counter-electrode defined by a surface of the engine block extending between said cylinders and facing said combustion chamber.

11. The engine of claim 1 wherein said connecting means include a bearing and wherein said crank is journalled in main bearings, said bearings being sealed from said crank chamber in at least one bearing chamber, and means for directing a lubricant to said bearing chamber, lubricant exiting said bearing chamber entering said crank chamber and being useable to lubricate said pistons.

12. The engine of claim 1 further including means for injecting fuel into said transfer port in a direction toward at least one of said inlets.

* * * * *